US008348495B2

(12) United States Patent
Kamiya

(10) Patent No.: US 8,348,495 B2
(45) Date of Patent: Jan. 8, 2013

(54) TIMEPIECE

(75) Inventor: Hideki Kamiya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 416 days.

(21) Appl. No.: 12/729,961

(22) Filed: Mar. 23, 2010

(65) Prior Publication Data

US 2010/0254227 A1 Oct. 7, 2010

(30) Foreign Application Priority Data

Apr. 1, 2009 (JP) ..... 2009-088862
Mar. 3, 2010 (JP) ..... 2010-046476

(51) Int. Cl.
*G04F 7/00* (2006.01)
*G04F 8/00* (2006.01)
*G04B 29/00* (2006.01)

(52) U.S. Cl. ..... 368/101; 368/110; 368/324

(58) Field of Classification Search ..... 368/101–106, 368/322–326, 110, 112; 29/896.3, 896.31; 148/403, 561
See application file for complete search history.

(56) References Cited

U.S. PATENT DOCUMENTS

| | | | | |
|---|---|---|---|---|
| 6,466,518 | B1 | 10/2002 | Akahane et al. | |
| 8,050,149 | B2 * | 11/2011 | Karapatis et al. | 368/244 |
| 2001/0030908 | A1 * | 10/2001 | Moteki et al. | 368/140 |
| 2004/0090868 | A1 * | 5/2004 | Endo et al. | 368/10 |
| 2009/0196125 | A1 * | 8/2009 | Tsuchiya et al. | 368/322 |
| 2009/0272246 | A1 * | 11/2009 | Richter | 84/297 S |
| 2011/0103199 | A1 * | 5/2011 | Winkler et al. | 368/285 |

FOREIGN PATENT DOCUMENTS

| | | | |
|---|---|---|---|
| JP | 2605696 | Y2 | 6/2000 |
| JP | 2009-150515 | A | 7/2009 |
| WO | WO-99/54792 | A1 | 10/1999 |

* cited by examiner

*Primary Examiner* — Vit W Miska
(74) *Attorney, Agent, or Firm* — Global IP Counselors, LLP

(57) ABSTRACT

A timepiece includes a striking member and a struck member that is driven when struck by the striking member, at least one of the striking member and the struck member being made from a metallic glass alloy.

5 Claims, 6 Drawing Sheets

TIMEPIECE

BACKGROUND

1. Technical Field

The present invention relates to a timepiece having a configuration in which a striking member strikes a struck member.

2. Related Art

Chronograph timepieces having an analog display using hands to indicate normal time also have chronograph hands such as a seconds chronograph hand and a minute chronograph hand to indicate chronograph time. The chronograph hands are made to start and stop keeping chronograph time, and are reset to zero, when operating buttons disposed to the timepiece are operated appropriately. The operation that returns the chronograph hand from where it stops to the original zero position ("return-to-zero" operation) is accomplished by pressing a flyback lever against a heart-shaped cam (heart cam) affixed to the staff on which the chronograph hand is disposed. See, for example, International Patent Application No. WO/1999/054792 and Japan Registered Utility Model U2605696.

In a chronograph timepiece such as described above the flyback lever presses against the heart cam. The flyback lever is thus a striking member and the heart cam is a struck member, and impact stress is produced by the collision between the flyback lever and the heart cam. More specifically, the staff becomes a striking member, the bearing becomes a struck member, and impact stress is produced between the staff and the bearing.

The impact stress produced by the collision between the striking member and the struck member can result in damage to or deformation of timepiece parts including the striking member and the struck member.

Considering in particular the bearing, that is, the struck member, if the bearing is made from a material with high hardness such as ruby, fractures may occur during use for a long period of time as a result of repeated impact between the staff and the bearing. Such fractures can be avoided by using a metal bearing, but the durability of metal bearings is poor, and wear from rotation of the staff and impact during the flyback operation can eventually deform the bearing. Yet, further, common metals that can improve resistance to wear and deformation are difficult to process and are not suited to mass production of timepieces.

SUMMARY

A timepiece according to the present invention prevents damage to and deformation of timepiece parts.

A first aspect of the invention is a timepiece including a drive body having a striking member and a struck member that is driven when struck by the striking member, at least one of the striking member and the struck member being made from a metallic glass alloy.

A metallic glass alloy is an alloy that includes elements satisfying specific conditions and having a metallic element as a main component, and is an amorphous metal alloy with a disordered atomic-scale structure. Such metallic glass alloys are formed, for example, by cooling the molten raw materials at a critical cooling rate of 104 K/s or greater. The properties of these metallic glass alloys include high wear resistance, high strength, a low Young's modulus, and high corrosion resistance.

At least one of the striking member and the struck member in this aspect of the invention is made from a metallic glass alloy material. When thus configured and the striking member strikes and drives the struck member, impact stress is applied to the striking member and the struck member, but the member made from the metallic glass alloy is protected from deformation by its high strength, and is protected from failure due to impact shock by its low Young's modulus. In addition, when friction is produced as a result of being driven when struck, wear caused by sliding friction is prevented by the high wear resistance of the metallic glass alloy. Problems such as deformation or failure of the striking member or struck member can therefore be prevented during long-term use without requiring maintenance, and the drive body can be driven stably for a long time.

Furthermore, metallic glass alloys can be molded by injection molding, and offer excellent moldability and good mold transfer characteristics. Yet further, because the surface of the molded part can be reproduced with high precision, post-processing such as by polishing is unnecessary, and production efficiency can be improved if the surfaces of the mold are finished to a mirror surface, the invention is also suited to mass production.

In a timepiece according to another aspect of the invention the striking member is a rotating body that has a shaft part and a heart cam that is affixed to the shaft part and rotates to a specific position when pushed by a pushing member; and the struck member is a bearing unit that rotatably supports the shaft part of the rotating body.

A metallic glass alloy such as described above is used in this aspect of the invention as the material for producing at least one of the shaft part of the heart cam and the bearing unit that rotatably receives the shaft part. The heart cam rotates when struck by the pushing member, and the shaft part rotates in conjunction therewith. At this time the shaft part rendered in unison with the heart cam collides with the bearing unit as a result of being struck by the pushing member, and impact stress is thus applied to the bearing unit. More specifically, the shaft part becomes the striking member and the bearing part becomes the struck member. As described above, deformation of the shaft part or bearing unit made from a metallic glass alloy is not a problem due to the high strength of the metallic glass alloy, failure of the part due to impact shock is prevented by its low Young's modulus, and wear caused by sliding friction due to rotation of the shaft part is prevented by the high wear resistance. The bearing unit can also stably support the shaft part without requiring maintenance during prolonged use. Metallic glass alloys are also suited to mass production of parts because they can be easily molded and shaped.

A timepiece according to another aspect of the invention also has a rotating body having a shaft part and a heart cam that is affixed to the shaft part and rotates to a specific position when pushed by a pushing member. In this aspect of the invention the striking member is the pushing member that can apply pressure to the heart cam, and the struck member is the heart cam of the rotating body.

In this aspect of the invention at least one of the heart cam and the pushing member that can apply pressure to the heart cam is made from a metallic glass alloy as described above. In this configuration the pushing member is the striking member and the heart cam is the struck member. Deformation and damage can also be prevented in this aspect of the invention if the pushing member or the heart cam is made from a metallic glass alloy as described above. Yet further, because metallic glass alloys can be easily processed, they are also suited to mass producing the heart cam and pushing member.

Further preferably in a timepiece according to another aspect of the invention, the rotating body is a chronograph wheel that supports a chronograph hand to indicate chronograph time, and the pushing member being a flyback lever that can move relative to the heart cam of the chronograph wheel between a flyback position applying pressure to the heart cam, and a retracted position separated from the heart cam.

In a timepiece with a chronograph according to this aspect of the invention, a heart cam is disposed to the chronograph wheel supporting the chronograph hand, the flyback lever returns the chronograph hand to zero by pushing the heart cam, and a metallic glass alloy is used for at least one of the shaft part of the chronograph wheel, the heart cam, the flyback lever, and the bearing unit. The flyback lever pushes the heart cam of the chronograph wheel every time the chronograph hand is reset to zero, and in this situation the flyback lever is the striking member and the heart cam is the struck member. When the flyback lever pushes against the heart cam, the shaft part supporting the heart cam strikes the bearing unit, and in this situation the shaft part is the striking member and the bearing unit is the struck member.

Because the flyback lever, the heart cam of the chronograph wheel, the shaft part of the chronograph wheel, and the bearing unit in a chronograph timepiece are subject to frequent impact shock, a material with high strength and a low Young's modulus must be used for these members. However, because a metallic glass alloy material is used for the flyback lever, the heart cam of the chronograph wheel, the shaft part of the chronograph wheel, and the bearing unit in a timepiece according to this aspect of the invention, damage, deformation, and wear of these members can be more reliably prevented, and high precision chronograph performance can be maintained during prolonged use.

In a timepiece according to the invention the metallic glass alloy is preferably a metallic glass alloy with a Zr, Co, Fe, or Ni based composition.

This aspect of the invention uses a metallic glass alloy with a Zr, Co, Fe, or Ni based composition. Metallic glass alloys with such a composition particularly provide high strength, a low Young's modulus, and wear resistance, and by using such a metallic glass alloy to form the striking member and struck member, parts that are tougher and more resistant to damage, deformation, and wear than common metal timepiece parts can be provided.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
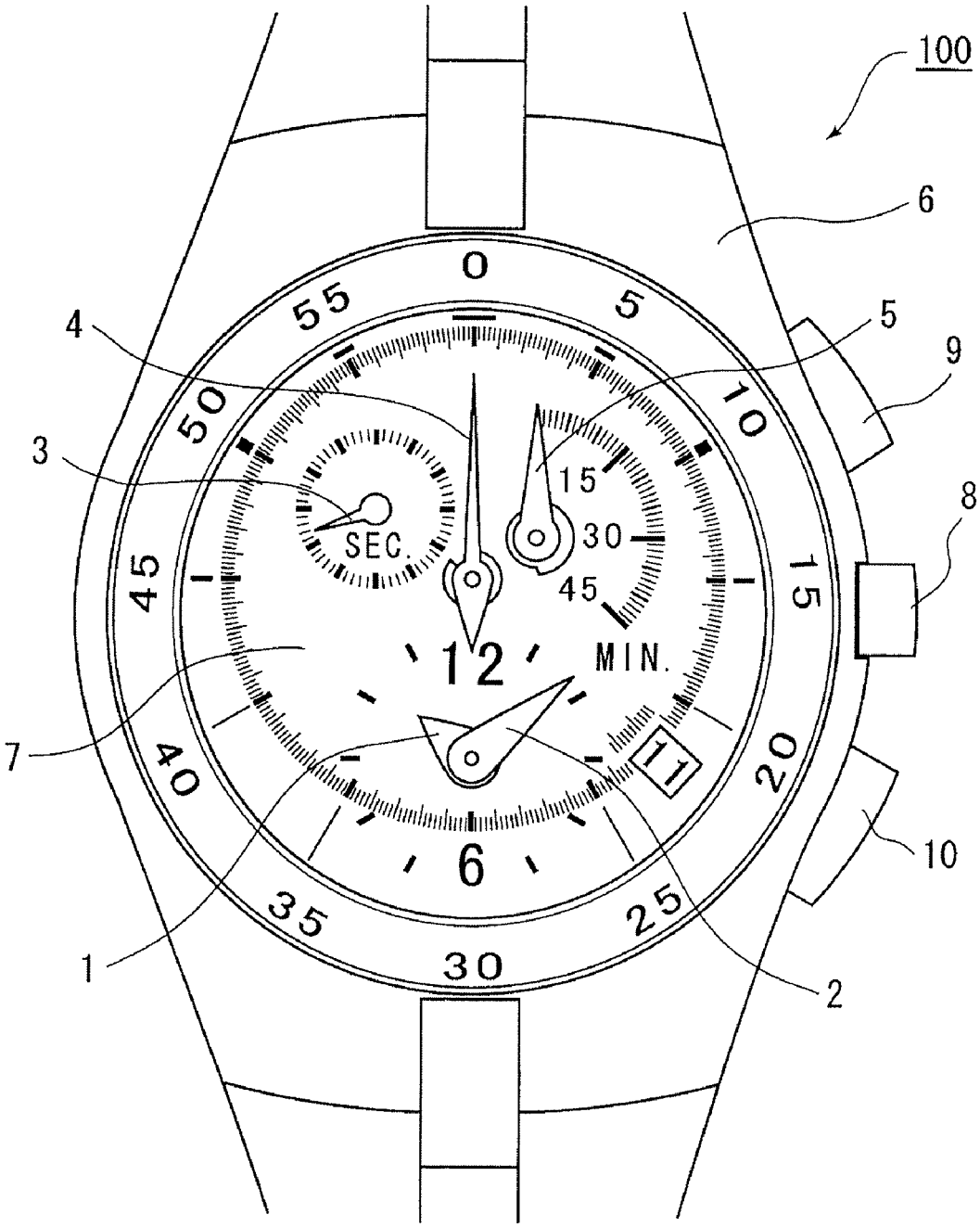
FIG. 1 is a top plan view of a chronograph timepiece according to a preferred embodiment of the invention.

FIG. 1 is a top plan view of a timepiece according to a preferred embodiment of the invention.

Referring to FIG. 1, a chronograph timepiece described below as a preferred embodiment of a timepiece according to the invention has an hour hand 1 and a minute hand 2 disposed coaxially to display the time in a common analog manner offset towards 6:00 o'clock from the center of the case 6 of the timepiece 100, and has a small seconds hand 3 for displaying the second of the normal time in a subsidiary dial at 10:00 o'clock.

A chronograph seconds hand 4 (a "chronograph hand" in the accompanying claims) for indicating the chronograph seconds is offset slightly eccentrically towards 12:00 o'clock from the center of the case 6 of the timepiece 100. A chronograph minute hand 5 (a "chronograph hand" in the accompanying claims) for indicating the chronograph minute moves through a fan-shaped subsidiary dial disposed near 2:00 o'clock. The chronograph in this embodiment of the invention can keep time for 45 minutes.

Indicia for displaying the normal time and indicia for displaying chronograph time are disposed on the dial 7 in the center of the timepiece 100. A crown 8 for adjusting the normal time is disposed to the timepiece 100 at 3:00 o'clock, a start/stop button 9 for starting and stopping the chronograph is disposed at 2:00 o'clock, and a reset button 10 for returning the chronograph hand to zero is disposed at 4:00 o'clock.

Figure 2:
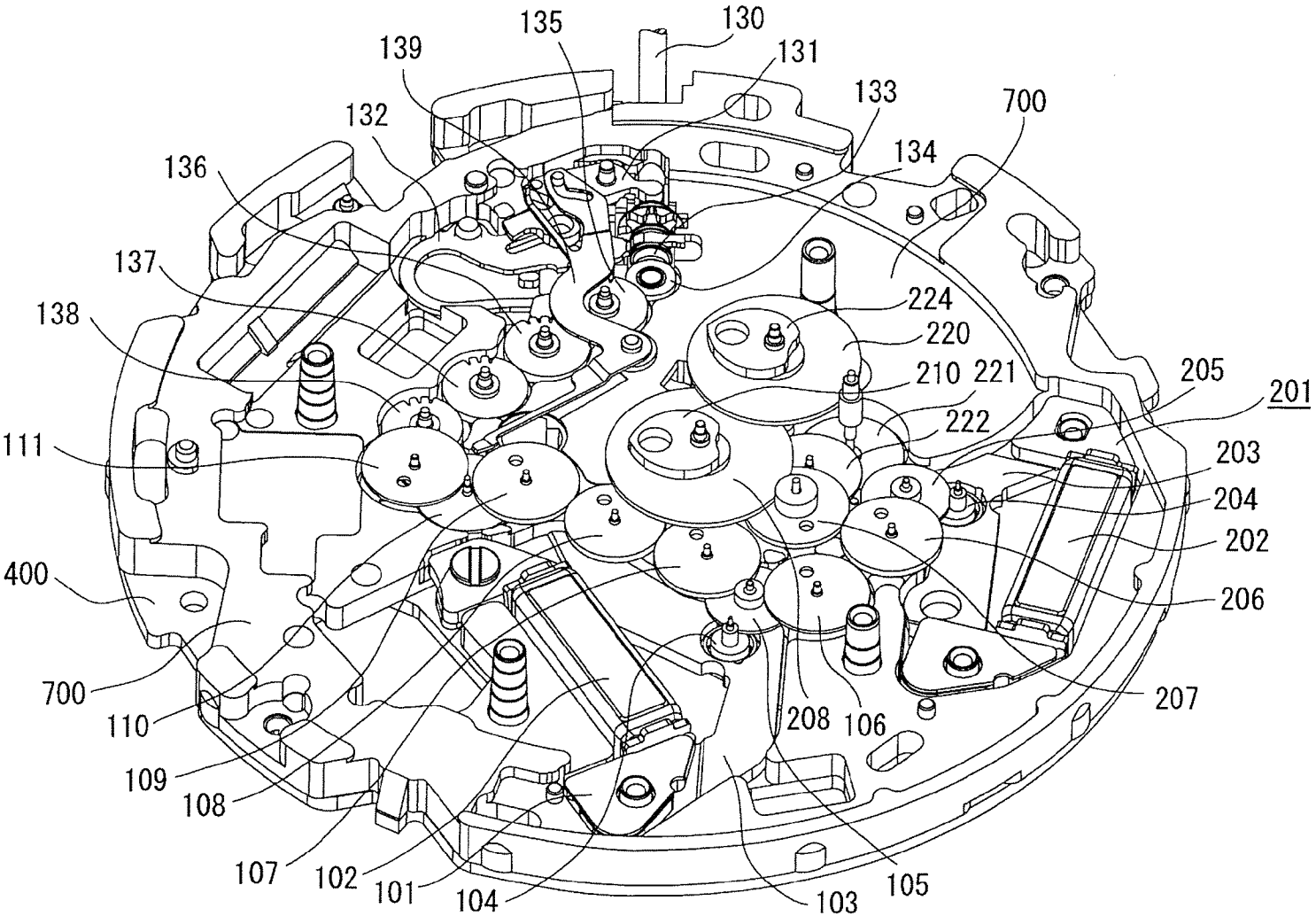
FIG. 2 is an oblique view of the main parts of a movement according to the invention.

FIG. 2 is an oblique view showing the main parts of the movement in this timepiece. FIG. 2 shows the main parts of the main wheel train for displaying normal time and the chronograph wheel train for displaying chronograph time, and does not show the bridge, circuit cover, or flyback holder that are disposed above the movement.

The basic configuration of the main wheel train for displaying the normal time is described next.

A plastic circuit bridge spacer 700 is fastened to the top of the main plate 400. The main timekeeping motor 101 that is the drive source for the main timekeeping operation includes a main coil 102, a main stator 103, and a main rotor 104. When a drive signal from an electronic circuit is applied, the main timekeeping motor 101 turns the main rotor 104 at the rate of one step per second. Rotation from main rotor 104 is transferred and slowed through a fifth wheel 105 to a small seconds wheel 106, and the second of the normal time is displayed by the seconds hand 3 (shown in FIG. 1) supported on the small seconds wheel 106. Rotation of the main rotor 104 is also slowed while being transferred through the fifth wheel 105, fourth third intermediate wheel 107, fourth second intermediate wheel 108, fourth first intermediate wheel 109, and third wheel 110 to the second wheel 111, causing the minute hand 2 (shown in FIG. 1) supported on the second wheel 111 to the display the minute of the normal time. Power is further transferred from the second wheel 111 through the minute wheel to the hour wheel (not shown in the figure) to display the hour of the normal time. These parts of the movement are the same as in a common electronic timepiece and are therefore not described in detail, but it should be noted that the hour, minute, and second of the normal time are arranged and displayed as shown in FIG. 1.

The stem 130 affixed to the crown 8 (shown in FIG. 1) is supported between the main plate 400 and the circuit bridge spacer 700, and when the stem 130 is pulled out, the setting lever 131 and yoke 132 work together and the clutch wheel 133 engages the setting wheel 134. The setting wheel 134 sequentially transfers rotation of the stem 130 to the third intermediate minute wheel 135, second intermediate minute wheel 136, first intermediate minute wheel 137, and the minute wheel 138 to adjust the normal time display. A train wheel setting lever 139 is engaged with the setting lever 131, and regulates the fourth first intermediate wheel 109 when the stem 130 is pulled out. The wheels and levers thus rendering the main wheel train are supported between the circuit bridge spacer 700 and the train wheel bridge 401 (shown in FIG. 4 without the main wheel train).

Figure 3:
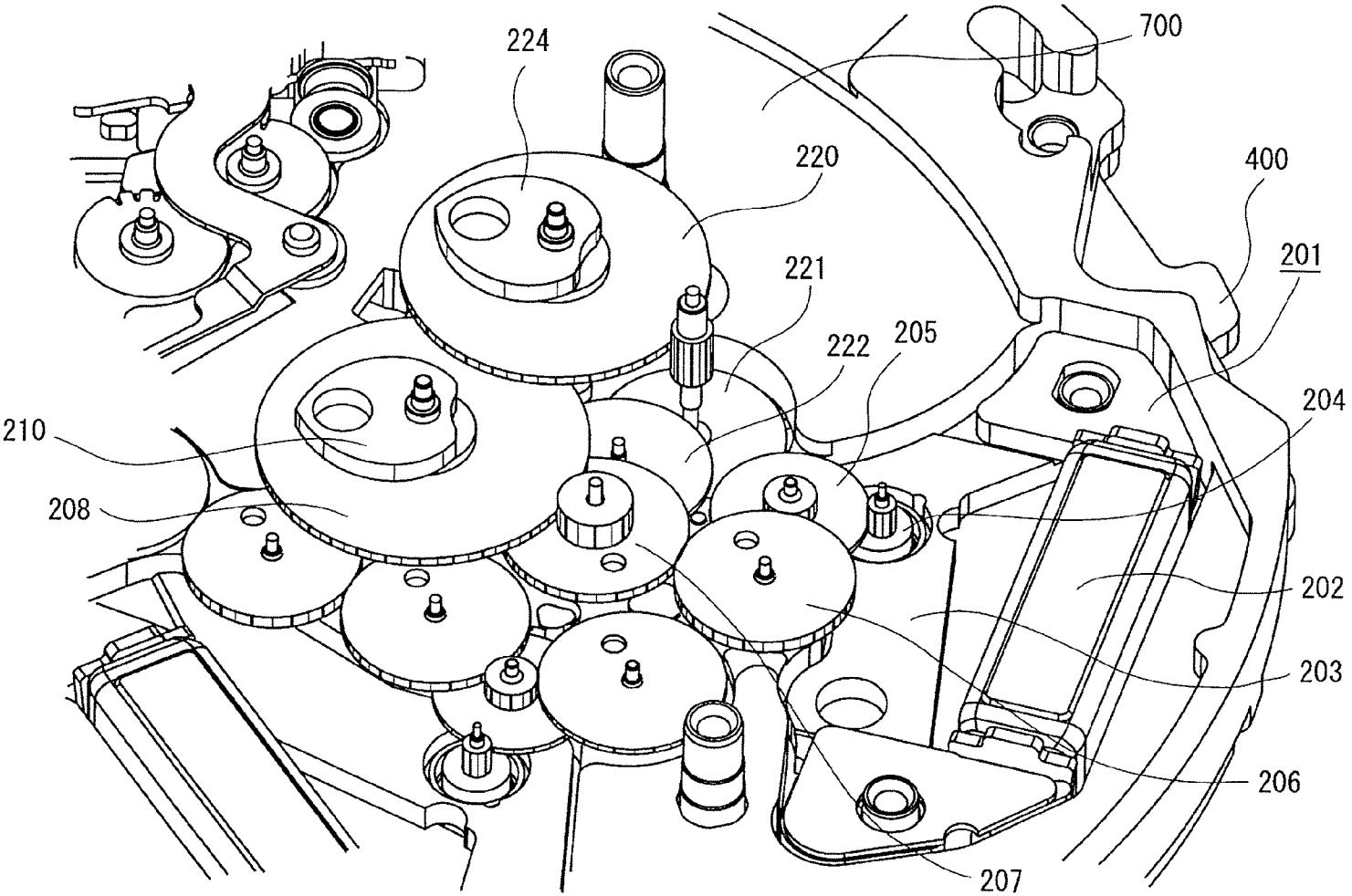
FIG. 3 is an enlarged oblique view of the chronograph wheel train shown in FIG. 2.

The chronograph wheel train is described next with reference to FIG. 3. FIG. 3 is an enlarged oblique view of the main parts of the chronograph wheel train shown in FIG. 2.

The chronograph motor 201 that is the drive source of the chronograph wheel train includes a chronograph coil 202, chronograph stator 203, and chronograph rotor 204. The chronograph rotor 204 is driven rotationally when a drive signal from an electronic circuit is applied thereto. Rotation of the chronograph rotor 204 is passed through the third intermediate chronograph seconds wheel 205, second intermediate chronograph seconds wheel 206, and first intermediate chronograph seconds wheel 207 to the chronograph seconds wheel 208, which is a rotating body, a chronograph wheel, and a struck member in the invention, thereby displaying the chronograph second by means of the chronograph seconds hand 4 (FIG. 1) that is supported on the chronograph seconds wheel 208. A flyback (return-to-zero) heart cam 210 is also disposed to the chronograph seconds wheel 208.

The chronograph minute wheel 220 that is a rotating body and chronograph wheel in the invention is driven in steps by the rotation of the chronograph motor 201 transferred from the first intermediate chronograph seconds wheel 207 to a second intermediate chronograph minute wheel 222 and first intermediate chronograph minute wheel 221, and the chronograph minute is displayed by the chronograph minute hand 5 (FIG. 1) supported on the chronograph minute wheel 220. A flyback heart cam 240 is also disposed to the chronograph minute wheel 220. A pinion that meshes with the chronograph minute wheel 220 and a pinion that meshes with the second intermediate chronograph minute wheel 222 (neither pinion shown in the figures) are also disposed to the first intermediate chronograph seconds wheel 207.

Figure 4:
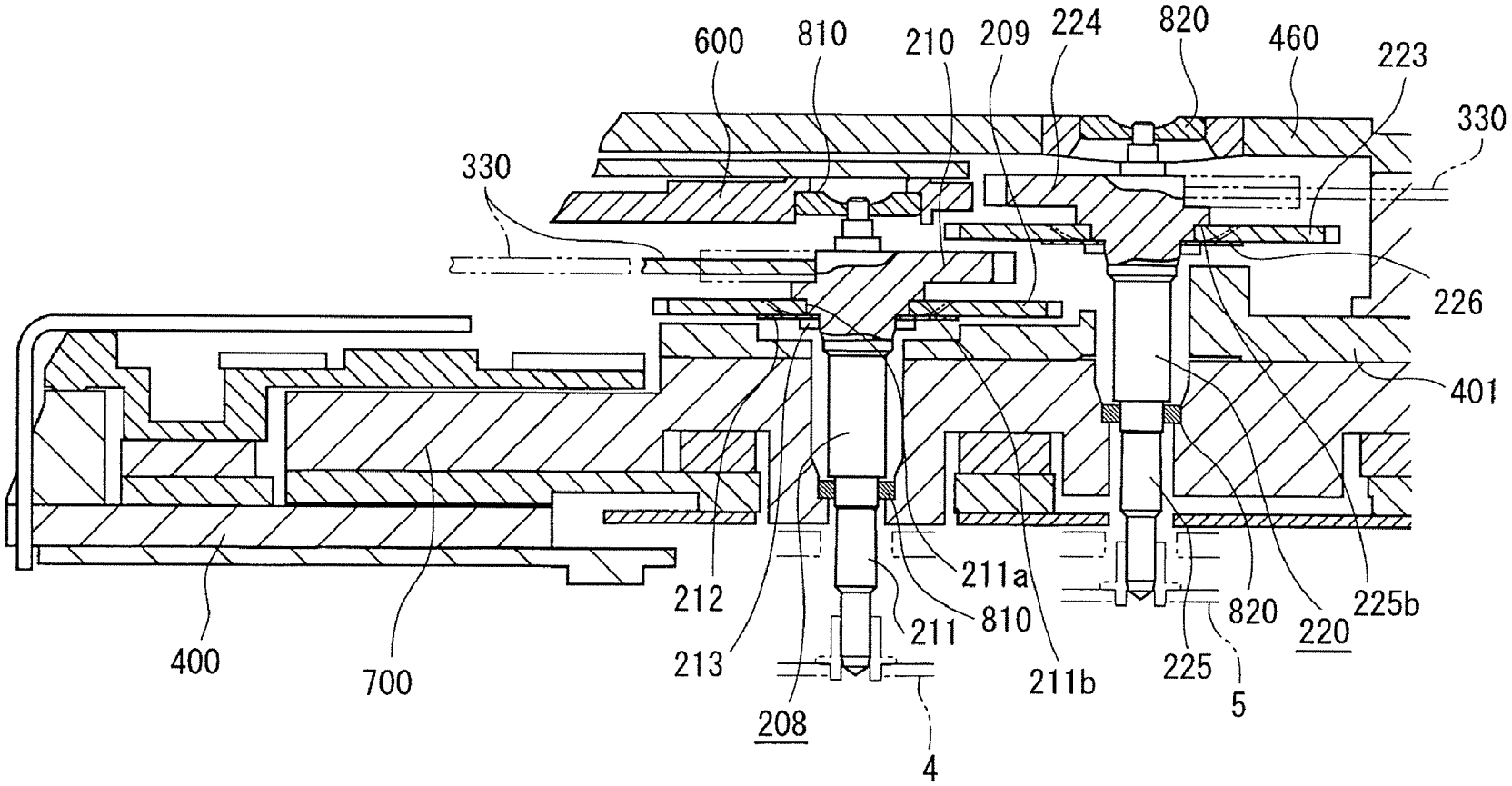
FIG. 4 is a section view through the seconds chronograph hand and the minute chronograph hand.

As shown in FIG. 4, the chronograph wheel train is thus supported between the circuit bridge spacer 700 disposed on top of the main plate 400, the circuit cover 600, and the rotor bridge 460 (shown in the FIG. 4).

FIG. 4 is a section view showing the configuration of the chronograph seconds wheel 208 and the chronograph minute wheel 220.

The chronograph seconds wheel 208 and the chronograph minute wheel 220 are identical, and are therefore described in detail below with particular reference to the chronograph seconds wheel 208.

The chronograph seconds wheel 208 includes a chronograph seconds wheel staff 211 as a shaft, the heart cam 210, and a chronograph seconds gear 209. The chronograph seconds wheel staff 211, heart cam 210, and chronograph seconds gear 209 are rendered in unison by injection molding metallic glass.

The chronograph seconds gear 209 is rotatably fit loosely to the bottom part 211*a* of the heart cam 210 disposed to the chronograph seconds wheel staff 211, and is pressed against the bottom shoulder 211*b* of the heart cam 210 by the elastic force of a slip spring 212. Note that while the chronograph seconds wheel staff 211 and the heart cam 210 are described as being rendered as a single integral part in this embodiment of the invention, the heart cam 210 and chronograph seconds wheel staff 211 may be rendered as discrete parts that are fastened together.

The slip spring 212 pushes against the chronograph seconds gear 209 with constant tension as a result of press fitting a slip spring holder 213 onto the chronograph seconds wheel staff 211. The contact parts of the heart cam 210 and the chronograph seconds gear 209 move together while the chronograph is operating as a result of pressure from the slip spring 212. When reset to zero, the side of the heart cam 210 is pushed and forced to rotate by a flyback lever 330, which renders a striking member and pushing member according to the invention. As a result, the chronograph seconds gear 209 and heart cam 210 slip, the chronograph seconds wheel staff 211 to which the heart cam 210 is affixed rotates, and the chronograph seconds hand 4 returns to zero. At this time the chronograph seconds gear 209 and other parts of the chronograph wheel train do not turn and remain normally engaged. Note that the chronograph seconds wheel 208 is supported by a chronograph seconds bearing 810 between the circuit bridge spacer 700 and the circuit cover 600.

The chronograph minute wheel 220 is configured identically to the chronograph seconds wheel 208 and further detailed description thereof is thus omitted except to note that the chronograph minute wheel 220 includes the chronograph minute wheel staff 225, which is a shaft in the accompanying claims, a chronograph minute gear 223, and heart cam 224. The chronograph minute wheel staff 225, heart cam 224, and chronograph minute gear 223 are formed in unison by injection molding metallic glass. The chronograph minute gear 223 is pushed against the heart cam shoulder bottom 225*b* by the elastic force of a slip spring 226. The chronograph minute wheel 220 is supported by a chronograph minute bearing 820 between the circuit bridge spacer 700 and the rotor bridge 460.

When reset to zero, the heart cam 224 is forced to turn by the flyback lever 330 so that it slips relative to the chronograph minute gear 223, and the heart cam 224 and chronograph minute wheel staff 225 rendered in unison therewith rotate and return the chronograph minute hand 5 to zero. The chronograph minute gear 223 and the rest of the chronograph wheel train do not turn, and remained normally engaged.

It should be noted that the chronograph seconds wheel 208 is rendered in this embodiment of the invention by injection molding the chronograph seconds wheel staff 211, the heart cam 210, and the chronograph seconds gear 209 in unison. Alternatively, however, the heart cam 210 and chronograph seconds wheel staff 211 may be molded in unison and fastened to the chronograph seconds gear 209 by screwing, welding, or adhesive bonding, for example, to render the chronograph seconds wheel 208. The chronograph minute wheel 220 may be similarly manufactured. More specifically, the heart cam 224 and chronograph minute wheel staff 225 may be molded in unison and fastened to the chronograph minute gear 223.

The chronograph seconds wheel staff 211 and the chronograph minute wheel staff 225 are rotatably supported by the chronograph seconds bearing 810 and chronograph minute bearing 820 as described above.

When the chronograph wheel train is driven, the flyback lever 330, which is a pusher, strikes the heart cams 210, 224, thereby causing the heart cams 210, 224 to turn and the chronograph seconds wheel 208 and chronograph minute wheel 220 to rotate therewith. When the flyback lever 330 pushes against the side of heart cam 210, the chronograph seconds wheel staff 211 rendered in unison with the heart cam 210 receives stress in the direction in which pressure is applied (the "pressure direction" below) and collides with the chronograph seconds bearing 810. The same happens with the chronograph minute wheel 220, that is, pressure from the flyback lever 330 causes the chronograph minute wheel staff 225 to collide with the chronograph minute bearing 820.

The flyback lever 330, chronograph wheels 208 and 220, and chronograph bearings 810 and 820 must therefore have toughness sufficient to prevent damage and deformation, for example, from the impact shock caused by these collisions, and the chronograph wheel staffs 211 and 225 must have wear resistance sufficient to withstand wear from the sliding friction of rotation.

In this embodiment of the invention, therefore, the flyback lever 330, chronograph wheels 208 and 220, and chronograph bearings 810 and 820 are made from metallic glass with, for example, a Zr based (such as Zr—Al—Ni—Cu), Co based (such as Co—Fe—Si—B—Nb), Fe based (such as Fe—Co—Ni—Si—B—Nb), or Ni based (such as Ni—Nb—Zr—Ti—Co—Cu) composition.

Metallic glass alloys having a Zr, Co, Fe, or Ni based composition are materials featuring high strength, a low Young's modulus, and high wear resistance, and a flyback lever 330, chronograph wheels 208 and 220, and chronograph bearings 810 and 820 made from such metallic glass alloys can prevent damage and deformation from impact shock. Wear from sliding against the chronograph wheel staffs 211 and 225 can also be prevented in the chronograph bearings 810 and 820.

The physical properties of a metallic glass alloy in which Zr is a main component are described next by way of example. A Zr-based metallic glass alloy has a Young's modulus of approximately 90 GPa and tensile strength of approximately 1600 MPa.

Crystalline metals with a Young's modulus close to that of a Zr-based metallic glass alloy include Zn with a Young's modulus of 80 GPa and tensile strength of 110-280 MPa, and duralumin, an Al alloy, with a Young's modulus of 71.5 GPa and tensile strength of 570 MPa, and cannot be imparted with the same strength as metallic glass alloys. Problems such as deformation from impact shock can thus occur in a flyback lever 330, chronograph wheels 208 and 220, and chronograph bearings 810 and 820 made from such crystalline metals.

In addition, crystalline metals with a Young's modulus close to that of a Zr-based metallic glass alloy also include nickel-chrome-molybdenum steel, for example, with a Young's modulus of 204 GPa and tensile strength of 1765 MPa. Manufacturing timepiece parts using such crystalline metals requires processing by means of cutting and machining, for example. Crystalline metals with such a high Young's modulus are not suited to mass production processes, however, because of the difficulty processing precision parts.

Yet further, rubies, which are a hard material, may be used for the chronograph bearings 810 and 820 that hold the chronograph wheels 208 and 220, but the Young's modulus of ruby is approximately 400 GPa and the tensile strength at room temperature is approximately 490 MPa. As a result, chronograph bearings 810 and 820 made of ruby have an extremely high Young's modulus and are subject to failure from the shock of impact with another member. Manufacturing bearings from ruby also requires a polishing process and is not suited to mass production due to difficult processing.

Compared with such hard materials as crystalline metal and ruby, metallic glass alloys enable achieving a low Young's modulus and high strength. More specifically, a flyback lever 330, chronograph wheels 208 and 220, and chronograph bearings 810 and 820 made from a metallic glass alloy are resistant to deformation from collisions because of their high strength, and are resistant to failure from impact shock due to a low Young's modulus. In addition, metallic glass alloys have good wear resistance, and can effectively suppress wear from sliding in contact with the chronograph seconds wheel staff 211 and chronograph seconds bearing 810, and wear from sliding in contact with the chronograph minute wheel staff 225 and chronograph minute bearing 820.

Furthermore, metallic glass alloys can be molded by an injection molding process, and thus enable forming the flyback lever 330, chronograph wheels 208 and 220, and chronograph bearings 810 and 820 quickly. Yet further, metallic glass alloys have good mold transfer properties in injection molding processes, and surface roughness can be improved and the need for polishing and other surface processing steps can be eliminated by rendering a mirror surface on the surfaces of the mold that form the timepiece parts.

In addition, the chronograph seconds wheel 208 having the chronograph seconds wheel staff 211, heart cam 210, and chronograph seconds gear 209 formed in unison, and the chronograph minute wheel 220 having the chronograph minute wheel staff 225, heart cam 224, and chronograph minute gear 223 formed in unison, can be produced by injection molding, and the efficiency of the assembly process can thus be improved compared with assembling multiple discrete parts.

Figure 5:
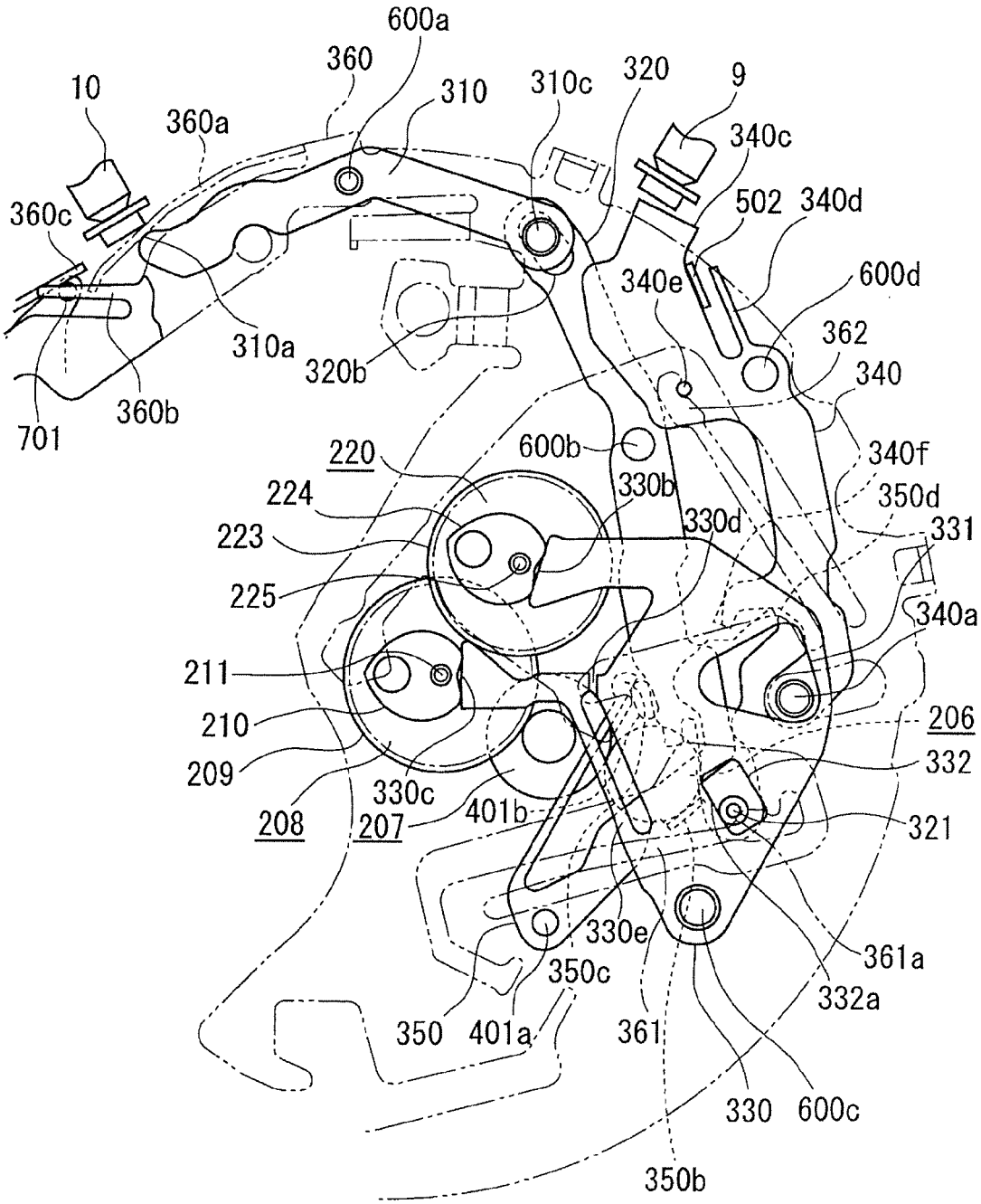
FIG. 5 is a plan view showing main parts during the flyback operation.

The configuration of the chronograph is described next with reference to FIG. 5 and FIG. 6. FIG. 5 is a plan view showing the main parts of the chronograph when reset to zero after pressing the reset button, and FIG. 6 is an oblique view of main parts shown in FIG. 5.

Figure 6:
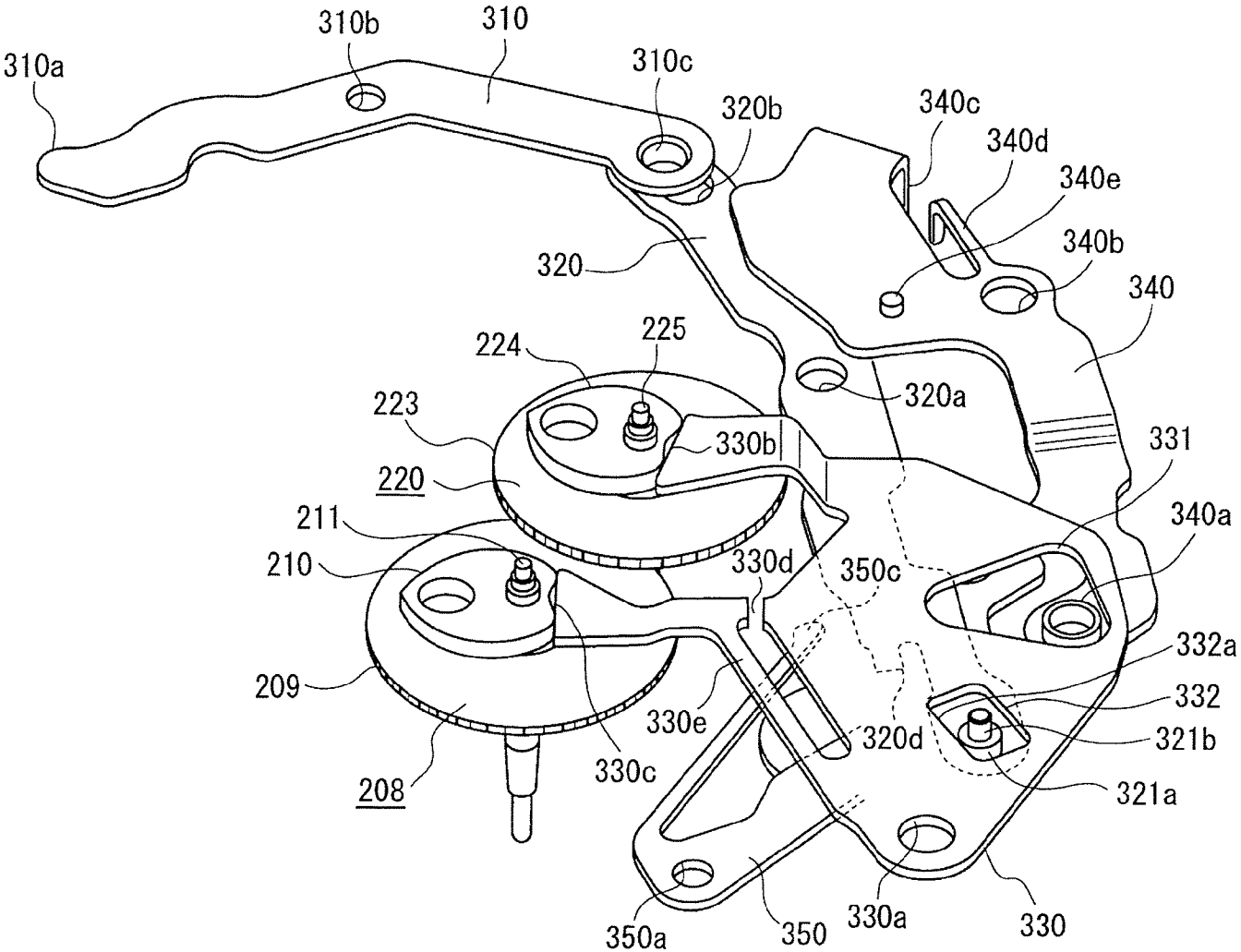
FIG. 6 is an oblique view of main parts shown in FIG. 5.

In FIG. 5 and FIG. 6 the start/stop button 9, which is a first external operating member, is in the initial position before the button is pressed. The reset button 10, which is a second external operating member, is shown in the depressed or pushed-in position. The flyback holder 360 forms a flyback spring 360*a* that is bent in part towards the main plate and contacts the distal end 310*a* part of relay lever 310. A hole 310*b* is formed in the relay lever 310 at a position corresponding to the relay lever pillar 600*a* rising from the molded plastic circuit cover 600, and is thus fit loosely on the relay lever pillar 600*a*. An operating pivot 310*c* is formed at the other distal end part of the relay lever 310 in unison with the relay lever 310, and this operating pivot 310*c* is engaged with a track-shaped hole 320*b* in a flyback relay lever 320.

A hole 320*a* is formed substantially in the center of the flyback relay lever 320, and is fit loosely onto a pillar 600*b* rendered in unison with the circuit cover 600. An operating pin 321 with two different diameters and a shoulder therebetween is disposed to the flyback relay lever 320 at the opposite distal end as the relay lever 310. The large-diameter part 321*a* of the operating pin 321 engages a substantially rectangular hole 332 in the flyback lever 330. The small-diameter part 321*b* of the operating pin 321 (see FIG. 6) engages a click spring 361. This click spring 361 is a positioning member that positions the flyback relay lever 320, and is formed in unison with the flyback holder 360.

The flyback lever 330 linked to the flyback relay lever 320 has a hole 330*a* opened therein corresponding to the pillar 600*c* disposed to the circuit cover 600, and is thereby fit loosely on the pillar 600*c*. A surface (contact surface 330*b*) that contacts the heart cam 224 of the chronograph minute wheel 220, and a surface (contact surface 330*c*) that contacts the heart cam 210 of the chronograph seconds wheel 208, are disposed to the flyback lever 330 near the timepiece center. The contact surface 330*c* side of the flyback lever 330 is interrupted by a slit 330*d* towards the contact surface 330*b* side, thereby rendering a spring 330*e*. A substantially triangular hole 331 rendered on the operating lever 340 side engages the operating pin 340*a* disposed to the operating lever 340.

The operating lever 340 has a hole 340*b* opened therein at a position corresponding to an operating pin 600*d* disposed to the circuit cover 600, and is thereby fit loosely to the operating pin 600*d*. The contact surface 340*c* that is contacted by the button when the start/stop button 9, which is a first external operating member, is pressed is formed bent down in section view. A switch input terminal 340*d* is formed integrally between the contact surface 340*c* and the hole 340*b*, and electrically connects to a start/stop button disposed to the side of the circuit board not shown when the start/stop button 9 is depressed. A stud 340*e* and the operating pin 340*a* are formed on the same surface of the operating lever 340 with the stud 340*e* engaging a click that is formed on the flyback holder 360 for positioning the operating lever 340, and the operating pin 340*a* engaging the substantially triangular hole 331 in the flyback lever 330.

A chronograph setting lever 350 has a hole 350*a* formed therein at a position corresponding to a pivot pin 401*a* disposed to the train wheel bridge 401, and is rotatably fit loosely thereon.

The chronograph setting lever 350 has a spring part 350*c* that contacts a side of a track-shaped protrusion 401*b* disposed to the train wheel bridge 401, a setting unit 350*b* that is bent near the second intermediate chronograph seconds wheel 206 to a position where the setting unit 350*b* engages the second intermediate chronograph seconds wheel 206 in section, and a beak-shaped distal end part 350*d* that engages the 340*f* of the operating lever 340. The chronograph setting lever 350 also engages a peninsular protruding part 320*d* of the flyback relay lever 320.

A timepiece with a chronograph according to this embodiment of the invention has a chronograph seconds wheel 208 having a chronograph seconds wheel staff 211 rendered in unison with a heart cam 210, a chronograph minute wheel 220 having a chronograph minute wheel staff 225 rendered in unison with a heart cam 224, a chronograph seconds bearing 810 rotatably supporting the chronograph seconds wheel staff 211, a chronograph minute bearing 820 rotatably supporting the chronograph minute wheel staff 225, and a flyback lever 330 configured so that the chronograph seconds wheel 208 and chronograph minute wheel 220 return to zero when the flyback lever 330 pushes the heart cams 210, 224. In addition, the flyback lever 330, chronograph wheels 208 and 220, and chronograph bearings 810 and 820 are made of a metallic glass alloy.

As a result, when the flyback lever 330 strikes a heart cam 210, 224, or a chronograph wheel staff 211, 225 collides with the corresponding chronograph bearing 810, 820, deformation and damage to the chronograph bearings 810 and 820 can be prevented. Wear caused by rotation of the chronograph seconds wheel 208 and chronograph minute wheel 220 can also be suppressed. As a result, even when the timepiece with a chronograph function is used for a long time, the chronograph wheels 208 and 220 can be driven stably and a highly precise chronograph time display can be maintained without a loss of accuracy or damage to the chronograph mechanism.

Furthermore, metallic glass alloys can be molded by injection molding, offer outstanding moldability, and good mold transfer characteristics. Therefore, if the surfaces of the mold are finished to a mirror surface, the surface characteristics of the molded product can be reproduced with high precision, and post-molding surface processes such as polishing can be eliminated.

Furthermore, a chronograph seconds wheel 208 having the chronograph seconds wheel staff 211, heart cam 210, and chronograph seconds gear 209 rendered in unison, and a chronograph minute wheel 220 having the chronograph minute wheel staff 225, heart cam 224, and chronograph minute gear 223 rendered in unison, can be easily produced by injection molding, and timepiece assembly can be made more efficient by using such chronograph wheels 208 and 220. The production efficiency of the flyback lever 330, chronograph wheels 208 and 220, and chronograph bearings 810 and 820 can therefore be improved, and timepiece production efficiency can be improved by using such timepiece parts.

The chronograph seconds bearing 810 and chronograph minute bearing 820 are made from a Zr, Co, Fe, or Ni based metallic glass alloy. Because such metallic glass alloys particularly have outstanding high strength, a low Young's modulus, and high wear resistance, such materials are particularly well suited for use in the chronograph bearings 810 and 820 to which contact pressure is applied from the flyback lever 330, and can be used to effectively prevent damage, deformation, and wear of the chronograph bearings 810 and 820.

Other Embodiments

It will be obvious to one with ordinary skill in the related art that the invention is not limited to the foregoing embodiment, the invention includes other configurations that can achieve the same object, and includes variations such as described below.

For example, the flyback lever 330, chronograph wheels 208 and 220, and chronograph bearings 810 and 820 are made of a metallic glass alloy in the foregoing embodiment, but a configuration in which only one of the flyback lever 330, chronograph wheels 208 and 220, and chronograph bearings 810 and 820 is made from a metallic glass alloy is also conceivable. While wear resistance is lower in such a configuration than in the embodiment described above, greater wear resistance can be achieved than is possible with a configuration using conventional metal timepiece parts.

Furthermore, if only the chronograph bearings 810 and 820 are made of a metallic glass alloy, greater shock resistance can be achieved than in a conventional configuration, and wear from rotation of the chronograph wheels 208 and 220 can also be effectively reduced.

Furthermore, the foregoing embodiment describes a flyback lever 330 as a striking member, chronograph wheels 208 and 220 having a heart cam 210, 224 as struck members, and chronograph bearings 810 and 820 as bearing units, but the invention is not so limited.

More specifically, a metallic glass alloy such as described above can be used for the timepiece parts of any part that is subject to a loss of accuracy or precision during long-term use due to failure, wear, or deformation when the timepiece is driven, including parts to which impact is applied, parts where gears mesh, for example, and parts to which pressure is applied. More specifically, while not shown in the accompanying figures, the pillar wheel that transfers power to the chronograph wheel train when the start/stop button 9 of the chronograph timepiece is depressed, and the operating cam jumper pressed against this pillar wheel, may be made from a metallic glass alloy.

Furthermore, configurations having a Zr, Co, Fe, or Ni based composition are described by way of example as a metallic glass alloy in the foregoing embodiment, but other amorphous metals produced using other metallic elements may be used.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application Nos.: 2009-088862, filed Apr. 1, 2009 and 2010-046476, filed Mar. 3, 2010 are expressly incorporated by reference herein.

What is claimed is:

1. A timepiece comprising:

a striking member; and a struck member that is driven when struck by the striking member, at least one of the striking member and the struck member being made from a metallic glass alloy; and a rotating body having a shaft part and a heart cam that is affixed to the shaft part and rotates to a specific position when pushed by a pushing member, the striking member being the shaft part of the rotating body, the struck member being a bearing unit that rotatably supports the shaft part.

2. The timepiece described in claim 1, wherein the rotating body is a chronograph wheel that supports a chronograph hand to indicate chronograph time; and the pushing member being a flyback lever that can move relative to the heart cam of the chronograph wheel between a flyback position applying pressure to the heart cam, and a retracted position separated from the heart cam.

3. The timepiece described in claim 1, wherein the metallic glass alloy is a metallic glass alloy with a Zr, Co, Fe, or Ni based composition.

4. A timepiece comprising:

a striking member; and a struck member that is driven when struck by the striking member, at least one of the striking member and the struck member being made from a metallic glass alloy; and a rotating body having a shaft part and a heart cam that is affixed to the shaft part and rotates to a specific position when pushed by a pushing member;

the striking member being the pushing member that can apply pressure to the heart cam; and the struck member being the heart cam of the rotating body.

5. The timepiece described in claim 4, wherein the rotating body is a chronograph wheel that supports a chronograph hand to indicate chronograph time; and the pushing member being a flyback lever that can move relative to the heart cam of the chronograph wheel between a flyback position applying pressure to the heart cam, and a retracted position separated from the heart cam.

* * * * *